US007322304B2

(12) United States Patent
Ishihara

(10) Patent No.: US 7,322,304 B2
(45) Date of Patent: Jan. 29, 2008

(54) MULTI-NEEDLE SEWING MACHINE

(75) Inventor: Kiyoyuki Ishihara, Ichinomiya (JP)

(73) Assignee: Kabushikikaisha Barudan, Ichinomiya-shi (JP)

( * ) Notice: Subject to any disclaimer, the term of this patent is extended or adjusted under 35 U.S.C. 154(b) by 91 days.

(21) Appl. No.: 11/364,340

(22) Filed: Mar. 1, 2006

(65) Prior Publication Data

US 2007/0101916 A1 May 10, 2007

(30) Foreign Application Priority Data

Nov. 10, 2005 (JP) ..... 2005-325756

(51) Int. Cl.
*D04B 49/00* (2006.01)
*D04B 47/00* (2006.01)

(52) U.S. Cl. ..... 112/302; 112/241

(58) Field of Classification Search ..... 112/241, 112/247, 302, 155, 98; 242/419, 129.1
See application file for complete search history.

(56) References Cited

U.S. PATENT DOCUMENTS 3,782,312 A * 1/1974 Kasuga ..... 112/241
5,642,678 A * 7/1997 Mizunuma et al. ..... 112/302
5,655,471 A * 8/1997 Tajima ..... 112/261
5,957,069 A * 9/1999 Shibata ..... 112/155
6,247,419 B1 * 6/2001 Tajima et al. ..... 112/98
6,729,251 B2 * 5/2004 Nishikawa et al. ..... 112/245

FOREIGN PATENT DOCUMENTS

JP 09-000765 1/1997

* cited by examiner

*Primary Examiner*—Ismael Izaguirre
(74) *Attorney, Agent, or Firm*—Connolly Bove Lodge and Hutz

(57) ABSTRACT

A multi-needle sewing machine capable of preventing twisting (twinning) associated with the oversupply state of a second thread element owing to the abrupt lowering of a thread take-up am even when the vertical reciprocation speeds of the needle bar and the thread take-up are increased to raise the efficiency of sewing. A recess is formed so that the second thread element that is pulled using the through hole of the thread take-up arm while at a bottom dead center can fall into the recess, the thread is lowered abruptly and is in a oversupply state and can be deflected within the recess bounded by jump preventing faces and a beaten thread portion face, so as to make contact with the faces and prevent the thread from jumping.

1 Claim, 6 Drawing Sheets

(A) (Prior Art)

(B) (Prior Art)

MULTI-NEEDLE SEWING MACHINE

FIELD OF THE INVENTION

The present invention relates to a multi-needle sewing machine equipped with multiple machine units arranged in parallel, each comprising a thread supply section, a thread take-up arm and a needle bar, in a machine head so as to be capable of making embroidery on cloth.

BACKGROUND OF THE INVENTION

In a conventional multi-needle sewing machine (for example, the multi-needle sewing machine disclosed in Japanese published unexamined patent application No. 09-000765), the sewing machine shown in the cross-sectional view of FIG. 5(A) is configured that an upper frame 2 is disposed above a machine table 1 extending lengthwise in the horizontal direction (in the depth direction of the figure) as is well known. Multiple machine heads 3 are disposed at equal intervals in the lateral direction (in the depth direction of the figure) on the front face (on the right side in FIG. 5(A)) of this upper frame 2. Each machine head 3 is equipped with a machine arm 5 secured to the front face of the upper fame 2 and a moving base frame 6 that is supported so as to be sidable in the lateral direction using a rail 4 provided on the front face of the machine arm 5. A needle bar drive mechanism 8 and a thread take-up arm drive mechanism 10, driven using a machine spindle 7 commonly passing through all the machine arms 5, are installed inside the machine arm 5 as shown in FIG. 5(A). The needle bar drive mechanism 8 comprises a needle bar drive cam 12 fitted on the machine spindle 7; a rod 13, the base portion of which is fitted on the needle bar drive cam 12; a drive arm 14, one end portion of which is pivotally supported using the machine arm 5, and the intermediate portion of which is connected to the rod 13; and a needle bar driver 16 connected to the end of the drive arm 14 and supported using a base needle bar 15 so as to be movable vertically, whereby the needle bar driver 16 is driven so as to be reciprocated vertically along the base needle bar 15 by the rotation of the machine spindle 7.

The thread take-up arm drive mechanism 10 comprises a thread take-up arm drive cam 17 fitted on the machine spindle 7; a thread take-up arm drive arm 18 that is pivotally supported using the machine arm 5 at its intermediate portion and rocked reciprocally using the thread take-up arm drive cam 17; and a drive gear 20 secured to the rocking-side end of the thread take-up arm drive arm 18, whereby the drive gear 20 is reciprocated vertically by the rotation of the machine spindle 7.

Next, machine units 37, each comprising a thread supply section (not shown), a thread take-up arm 22, a needle bar 21, etc. are disposed in the moving base frame 6 as shown in FIG. 5(A). The multiple sets of the machine units 37 are arranged in parallel as shown in FIG. 1. The machine units 37 are made selectable by providing the moving base frame 6 so as to be movable in the lateral direction with respect to the frame 2.

Next, the configuration of the machine unit will be described using FIG. 5 (A) showing one machine unit 37.

Multiple needle bars 21 arranged in the depth direction in the figure are provided in the needle bar mechanism section 6*c* of the moving base frame 6 so as to be movable vertically.

An engaging pin 23, directed backward, is protruded at the vertically central portion of each needle bar 21 as shown in FIG. 5(A). The engaging pin 23 of the needle bar 21 selected by the needle bar selection operation associated with the sliding of the moving base frame 6 described later is fitted in the engaging groove 16*a* formed in the front face of the needle bar driver 16 in the machine arm 5, whereby the needle bar 21 is reciprocated vertically via the needle bar driver 16 by the rotation of the spindle 7. Numeral 19 designates a presser foot having a well-known configuration.

In correspondence with each needle bar 21, the thread take-up arm 22 is rockably provided above the needle bar 21 in the thread take-up arm mechanism section 6*b* of the moving base frame 6.

A boss 22*a* secured to the base portion of each thread take-up arm 22 is rotatably fitted on a thread take-up arm shaft 24 that is supported on the moving base frame 6 along the sliding direction of the case. A driven gear 25 that can be meshed with the drive gear 20 provided at the rocking end of the thread take-up arm drive arm 18 is formed around the outer circumference of the boss 22*a*. In addition, a fitting groove 26 (FIG. 5(A)) that faces downward when the thread take-up arm 22 has a predetermined posture (a posture obtained when the thread take-up arm is located near the top dead center) is formed in each boss 22*a*, and this fitting groove 26 is slidably fitted on a thread take-up arm rail 27 that is secured to the upper face of the end of the machine arm 5 and extends in the sliding direction of the moving base frame 6. In other words, each thread take-up arm 22 is held in the posture obtained near the top dead center by fitting the fitting groove 26 on the thread take-up arm rail 27. Because this thread take-up arm rail 27 does not have a portion that acts on the front portion of the drive gear 20 of the thread take-up lever aim 18, the fitting groove 26 of the thread take-up arm 22 that acts on the front portion of the drive gear 20 so that the driven gear 25 is engaged with the drive gear 20 is away from the thread take-up arm rail 27, whereby the thread take-up arm 22 is reciprocated between the top dead center 22*e* and the bottom dead center 22*f* thereof by the reciprocating movement of the thread take-up lever drive arm 18 under the engagement between the drive gear 20 and the driven gear 25.

Next, numerals 31, 32, 34 and 35 indicated on the right side of the machine head 3 in FIG. 5(A) respectively designate thread guide eyes having through holes configured to facilitate thread passing as is well known, and the thread guide eyes are used to guide the thread (41 to 46). Numeral 41 designates the thread that goes from a spool (not shown) positioned above to the thread guide eye 31 as is well known, numeral 42 designates a first thread element going from the thread guide eye 31 to the thread guide eye 32 positioned below, numeral 43 designates a second thread element that makes a U-turn at the thread guide eye 32 and goes to the through hole 33 of the thread take-up arm 22 positioned above, numeral 44 designates a third thread element that makes a U-turn at the through hole 33 of the thread take-up arm 22 and goes to the thread guide eye 34 positioned below, numeral 45 designates a thread element going downward from the thread guide eye 34 to the thread guide eye 35, and numeral 46 designates a thread element that is supplied to a needle and goes from the thread guide eye 35 to the through hole of a needle 21*a*.

Recently, for the purpose of raising the efficiency of sewing, the rotation speed of the machine spindle 7 is increased, and the vertical reciprocation speeds of the needle bar 21 and the thread take-up arm 22 are increased significantly. However, when the speed of the reciprocating operation of the thread take-up arm 22 is increased significantly, the following problems occur.

First, the sewing operation for cloth 29 will be described using the machine unit 37 of the above-mentioned conventional multi-needle sewing machine. As is well known, by the high-speed rotation of the spindle 7, the needle bar 21 is moved toward a thread-supplying hook 28, and the thread take-up arm 22 is reciprocated vigorously in the vertical direction between the top dead center position 22*e* and the bottom dead center position 22*f* at the timing shown in FIG. 6, whereby sewing is carried out while the thread 41 is drawn out to the cloth. During this sewing operation, when the thread take-up arm 22 is moved from the top dead center position 22*e* to the bottom dead center position 22*f* shown in the figure, the thread take-up arm 22 abruptly lowers in almost synchronization with but slightly behind the operation of the needle bar 21 (refer to the timing chart of FIG. 6).

The thread element in the upper portion of the thread (the second thread element 43) located between the through hole 33 of the thread take-up arm 22 located at the top dead center position 22*e* and the thread guide eye 32 positioned below and having a predetermined length is abruptly pulled downward along a lowering locus 33*a* by the abrupt lowering of the through hole 33 of the thread take-up arm 22 to the bottom dead center position 22*f*; hence oversupply occurs at the space 33*b* between the through hole 33 located at the bottom dead center 22*f* and the thread guide eye 32, thereby causing a phenomenon in which the second thread element becomes uncontrollable in the wide space 33*b* near the thread guide eye 32 while instantaneously making a small loop.

In that case, when sewing is carried out using an ordinary thread, the thread take-up arm 22 immediately rises toward the top dead center position 22*e*, thereby dissolving the problem of the above-mentioned oversupply.

However, various kinds of threads have been provided because of the development of chemical fibers, and various types of thread twisting, such as left twisting, right twisting, strong twisting and weak twisting, have become available; hence, the end of the loop is formed to have an acute angle owing to thread twisting (twining) at the moment of the "oversupply state" in the space 33*b* between the through hole 33 and the thread guide eye 32 depending on the property of the thread, and the end of the loop is twined narrowly. For example, the end of the loop is twined to have the state indicated by numeral 43*b* in FIG. 5 (B). When the thread take-up arm 22 immediately rises toward the top dead center 22*e* while this twined state remains, the twined (twisted) portion 43*b* of the thread is pulled and cut off, thereby causing a problem.

BRIEF SUMMARY OF THE INVENTION

An object of the present application is to provide a multi-needle sewing machine capable of making embroidery by selectively using multiple machine units arranged in parallel.

Another object of the present application is to provide a multi-needle sewing machine having a thread twining (twisting) preventing unit that can be configured in a narrow width space even when the width of a machine head in which the multiple machine units arranged in parallel are installed is small.

Still another object of the present application is to provide a multi-needle sewing machine capable of effectively preventing the twisting (twining) of the second thread element that becomes an "oversupply state" owing to abrupt lowering, by disposing a receiving member or the like having a very simple configuration at a position deeper than the bottom dead center position of the thread take-up arm even when the vertical reciprocation speeds of the needle bar and the thread take-up arm are increased to raise the efficiency of sewing.

The other objects and advantages of the present invention will become clear easily from the drawings and the following descriptions related thereto.

A multi-needle sewing machine being configured:

a moving base frame 6 is provided on the front side of a machine head 3 so as to be able to reciprocate in the lateral direction, and multiple machine units 37 are arranged in parallel on the moving base frame 6, each machine unit 37 comprising a thread supply section 6*a*, a thread take-up arm 22 and a needle bar 21 in this order from above, said moving base frame 6 is reciprocated in a lateral direction 65 so that any one of said multiple machine units 37 can be selected and used, at an upper position of a thread passage 51 on one side of said thread take-up arm 22 in each machine unit 37, a first thread guide eye 31 for guiding a first thread element 42 supplied from said thread supply section 6*a* to a second thread guide eye 32 provided below via said thread passage 51 is provided, and a position of said second thread guide eye 32 is determined at a lower position below said thread passage 51 and below the position of a through hole 33 of said thread take-up arm 22 located at the bottom dead center 22*f* while having a predetermined space 59, said second thread guide eye 32 is configured so as to be able to return said first thread element 42 and to guide said thread element serving as a second thread element 43 toward said through hole 33 of said thread take-up arm, and a third thread guide eye 34 is provided in the vicinity said second thread guide eye 32 so as to be able to guide a third thread element 44 going to a needle 21*a* after passing through said through hole 33 of said take-up arm, when sewing is carried out by vertically moving said thread take-up arm 22 and said needle bar 21 of said machine unit 37, said first thread element 42, said second thread element 43 and said third thread element 44 are sequentially guided using said first thread guide eye 31, said second thread guide eye 32, said through hole 33 of said thread take-up arm and said third thread guide eye 34, thereby advancing toward said needle, wherein in said thread passage 51 of each machine unit 37, in an upper half zone 60 at least in said space 59 between the position of said through hole 33 of said thread take-up arm located at the bottom dead center 22*f* and the position of said second thread guide eye 32 provided therebelow, when said through hole of said thread take-up arm lowers abruptly from a top dead center to the bottom dead center, said second thread element 43*a* that is pulled using said through hole 33 of said thread take-up arm and abruptly lowered, and said second thread element being in an oversupply state is deflected; in a depth direction to which said second thread element is deflected and at a position near a place in which a beaten portion of said second thread element being deflected can be received, a beaten thread receiving face 53*a* is provided, and jump preventing faces 54*a* are provided to make the beaten portion 43*a* of said second thread element come into contact with positions on both sides of said receiving face 53*a* and enclosing a front space of said receiving face so as to prevent the oversupply portion 43*a* of said second thread element 43 from jumping.

When embroidery is made on cloth in the present invention, the multiple machine units arranged in parallel are moved laterally and used selectively, thereby being capable of making beautiful embroidery on the face of the cloth.

Even when thread take-up arms 22, needle bars 21, etc., to be arranged in parallel on a moving base frame 6 in a machine head, are arranged in parallel at narrower intervals therebetween to downsize the machine head, a beaten thread receiving face 53*a* according to the present invention can be provided at the narrower intervals.

In other words, because each beaten thread receiving member 53 provided in a twisting (twining) preventing member 50 is disposed at a recessed position at the bottom dead center of the thread take-up arm to receive a second thread element 43 that is deflected thereto when the thread take-up arm lowers, its area occupied in the width direction can be made very small.

This is applicable to a situation in which the needle bars 21 are arranged in parallel at narrower intervals to downsize the width of the machine head as described above.

Furthermore, in the present invention, even when the rotation speed of the spindle is increased and the vertical reciprocation speeds of the needle bar and the thread take-up arm are increased to raise the efficiency of sewing, the second thread element 43 that is deflected downward in an "oversupply state" as the through hole 33 of the thread take-up arm is lowered abruptly toward the bottom dead center is received using the beaten thread receiving member 53. Because the second thread element 43 is received in this way, the second thread element 43 spreads in a dispersed state along the receiving member 53 and the respective "wall faces" of the jump preventing members 54 positioned on both sides of the receiving member in a state of being pressed against the respective "wall faces," and is pulled up as the thread take-up arm is then raised abruptly toward the top dead center, without having a chance of twisting (twining).

In the present invention, the second thread element 43 being in the "oversupply state" owing to abrupt lowering toward the bottom dead center can be attached to the "wall face" of the receiving member 53 having a very simple configuration in a free space, without having a time of causing an uncontrollable phenomenon, whereby the present invention has an outstanding effect capable of effectively preventing twisting (twining).

DETAILED DESCRIPTION OF THE INVENTION

Figure 1:
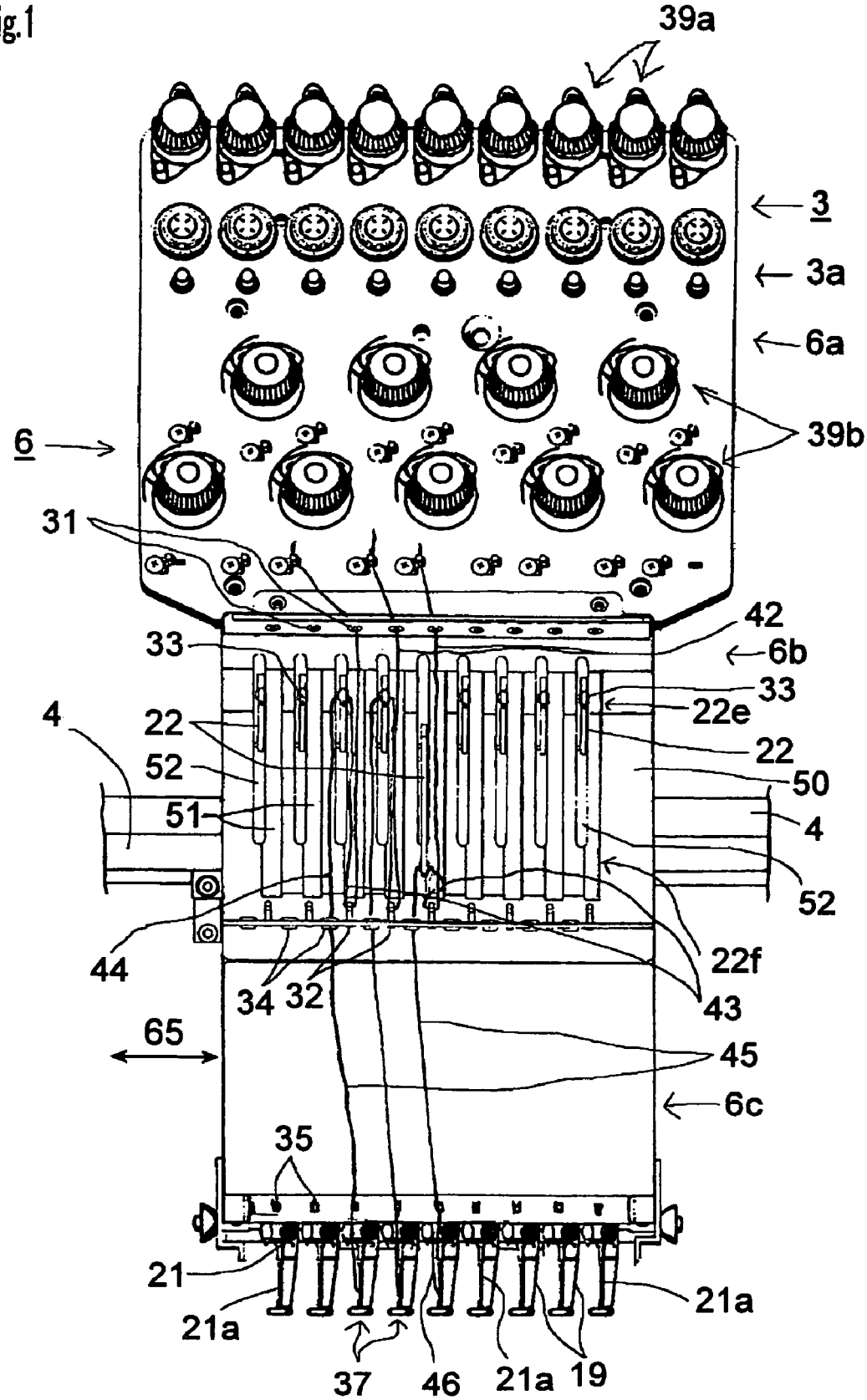
FIG. 1 is a front view showing the moving base frame 6 of a machine head.

An embodiment of the present application will be described below using FIGS. 1 to 6. Generally speaking, in the case that multiple machine units 37, each comprising a supply section 3*a* for supplying thread 41, a thread take-up arm 22 and a needle bar 21, are arranged in parallel on a machine head 3, and that embroidery is made on cloth 29, a configuration in which one of the multiple machine units is selected and used is widely known as a well-known matter. In addition, embroidery using the selected machine unit has been described in detail as common technical knowledge using FIG. 5(A), a known figure, as described above.

Hence, for understanding the embodiment of the present application shown in FIGS. 1 to 4, the understanding should be done on the premise of the technical matters including the above-mentioned known matter.

In the case that the configuration and the operation regarding the machine head 3, the moving base frame 6, the thread supplied from the thread supply section 3*a* to the needle 21*a*, the thread take-up arm 22, the needle bar 21, etc. shown in FIGS. 1 to 4 are easier to understand when they are described in relation to the technical matters shown in FIG. 5(A), refer to the technical matters shown in FIG. 5(A) because the same numerals as those used in FIG. 5(A) are used.

Next, numeral 3 designates the machine head provided on the front side of the frame, and numeral 6 designates the moving base frame that moves laterally under the guidance of a rail 4 provided on the front side of a machine arm. In the moving base frame 6, the multiple machine units, each comprising the thread supply section 6*a*, the thread take-up arm 22 and the needle bar 21 as is well known, are provided as shown in the figure.

In the moving base frame 6, numeral 6*a* indicated above designates the thread supply section, and the thread supply section comprises multiple tension mechanisms 39*a*, multiple thread breakage detectors 39*b*, etc., the number of which corresponds to the number of the needles, as is well known, and the thread supply section is configured so as to be able to supply the thread 41 (including thread elements designated by numerals 42, 43, 44, 45 and 46) from each of multiple spools (not shown) disposed above to the needle 21*a* corresponding thereto. In the figure, the thread is shown partially, and the other most portions thereof are not shown in the figure because they are well known.

Figure 2:
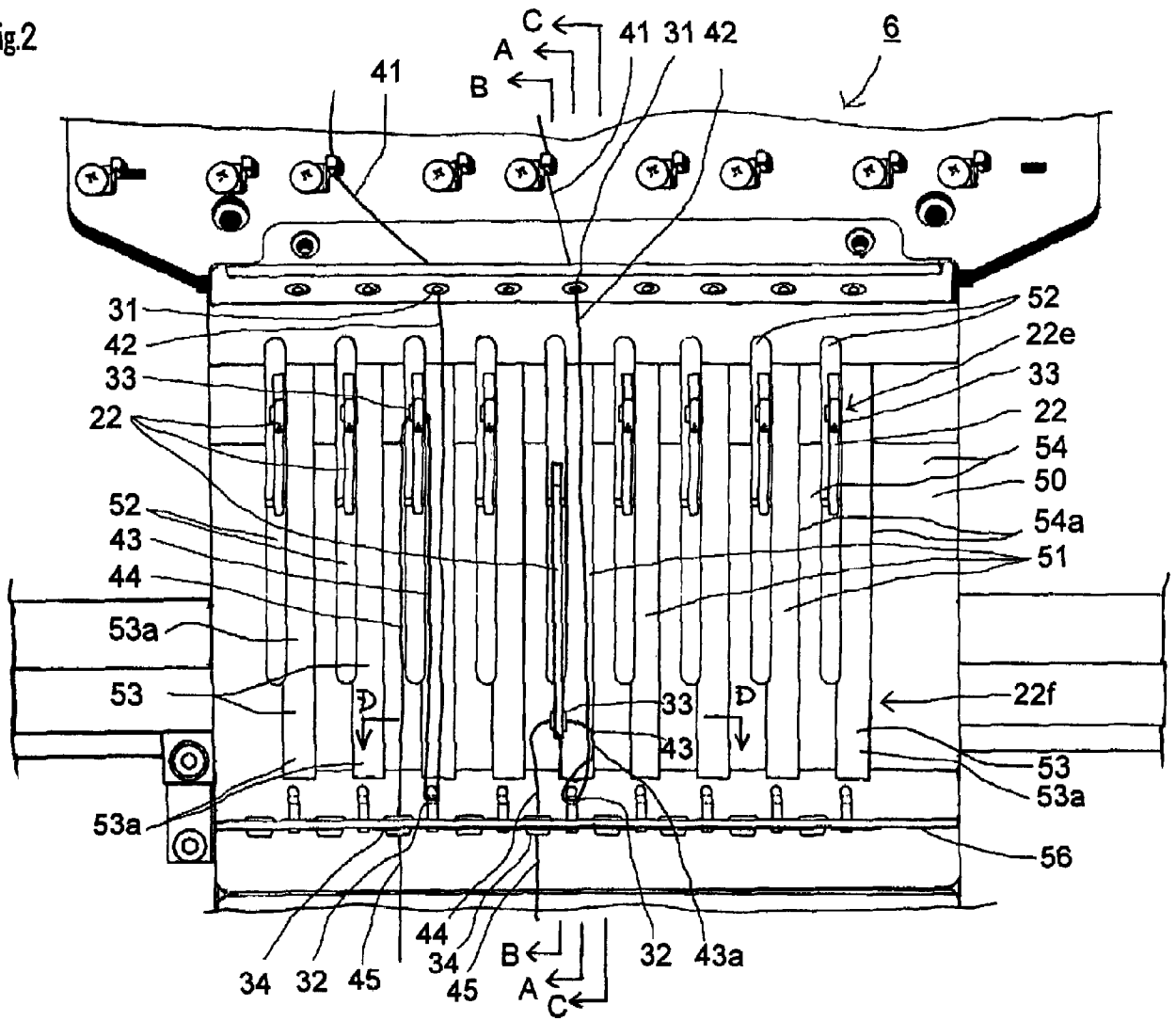
FIG. 2 is a partially magnified front view showing the thread take-up arm mechanism section of the moving base frame and illustrating the positional relationship among the through hole of a thread take-up arm, a second thread element, a first thread element and a beaten thread receiving face so as to be understood easily.

In the moving base frame 6, numeral 6*b* indicated in the intermediate portion of FIG. 1 designates a thread take-up arm mechanism section; as described using FIG. 5(A), a thread take-up arm mechanism including a mechanism section selectively operated in relation to the operation of the thread take-up arm drive mechanism 8 is incorporated inside the section, and is configured so that multiple take-up arms 22, 22, . . . , 22 arranged in parallel as shown in FIG. 2 can be selectively driven vertically.

In this thread take-up arm mechanism section 6*b*, a plate-like cover (a cover integrally molded using a synthetic resin) 50 exemplified as a thread twining preventing member is removably installed using appropriate fasteners, such as screws, while having an appropriate clearance 6*f* from the surface 6*e* of the thread take-up arm mechanism section.

The thread twisting preventing member 50 is configured to have a size capable of covering the surface 6*e* of the thread take-up arm mechanism section. On the surface of the preventing member 50, thread take-up arm passing slits 52 are arranged in parallel, the number of which corresponds to the number of the thread take-up arms 22, and each of the thread take-up arm passing slits 52 is required to vertically move the through hole 33 of each of the multiple thread take-up arms arranged in parallel between the top dead center 22*e* and the bottom dead center 22*f* (for example, approximately 60 mm) using a thread take-up arm shaft 24 as a pivot shaft. In addition, on one side (the side through which the first thread element 42 corresponding to each thread take-up arm is passed) of each of the multiple slits 52, a thread passage 51 formed in a recess shape so as to cause the first thread element 42 to pass through between the first thread guide eye 31 and the second thread guide eye 32 is provided as shown in FIG. 2. Furthermore, in each machine unit 37, a jump preventing member 54 is provided in the thread passage 51 on the side of the adjacent machine unit. The jump preventing member 54 is formed in parallel with the passing locus (42) of the first thread element 42 so as to become a jump preventing face 54*a* that makes the first thread element 42 come into contact with the wall face and reduces the lateral wobbling when the first thread element 42 wobbles laterally owing to the wind pressure caused at the time of the lowering of the thread take-up arm. The height (the dimension extending in the left direction of FIG. 3) of the jump preventing member 54 is made larger than the passing locus 42 of the first thread element and smaller than the reciprocating locus 33*a* of the through hole 33 of the thread take-up arm; the jump preventing member is thus positioned at an intermediate position between the two.

The height of the jump preventing member 54 is made lower than the passing locus 42 of the first thread element as shown in the figure to avoid disturbance at the beaten portion 43*a* of the second thread element 43 owing to the wind pressure from the thread take-up arm lowering abruptly near the bottom dead center of the thread take-up arm.

In the thread passage 51 of each machine unit 37, as shown in FIG. 2, at least in the space 59 between the position of the through hole 33 of the thread take-up arm 22 located at the bottom dead center 22*f* and the position of the second thread guide eye 32 provided therebelow, a "beaten thread receiving face 53*a*" is provided in the upper half zone 60 thereof (for example, approximately 6 to 8 mm). When the through hole 33 of the thread take-up arm lowers abruptly in the direction of the curved passing locus 33*a* from the top dead center to the bottom dead center, the second thread element 43 that is pulled using the through hole 33 of the thread take-up arm and abruptly lowered is deflected to the "beaten thread receiving face 53*a* in the depth direction (the right direction in FIG. 2) of the through hole 33 of the thread take-up arm in an "oversupply state." In the depth direction to which the second thread element 43 being in this "oversupply state" is deflected and at a position near the place in which the beaten portion 43*a* of the second thread element 43 being deflected as described above can be received (the portion with which the "oversupply portion" of the second thread element 43 from the through hole 33 of the thread take-up arm makes contact, that is, a deflecting dimension 62, for example, approximately 10 mm (approximately 6 mm to 16 mm)), the "beaten thread receiving face 53*a*" formed of the surface of the beaten thread receiving member 53 is provided. Hence, the portion 43*a* of the second thread element 43 being formed into a loop shape in the deflected "oversupply state" becomes a "state of clinging" to the "face" of the "beaten thread receiving face 53*a*", and the loop portion is pulled up as the through hole 33 of the thread take-up arm is raised abruptly without having a time of making an acute angle and forming twining.

Furthermore, at the positions on both sides of the receiving face 53*a* and enclosing the front space 51 of the receiving face 53*a*, the jump preventing faces 54*a* and 54*a* are provided to make the beaten portion 43*a* of the second thread element 43 come into contact with and cling to the "face", thereby preventing the second thread element 43 from jumping. The depth dimension 61 of the thread passing groove and the width dimension 63 of the thread passing groove cannot be determined uniformly because the deflecting inertia of the thread 41 is different depending on the rotation speed of the spindle (the lowering speed of the thread take-up arm), the kind, the thickness and the type of twisting of the thread, as in the case of the deflecting dimension 62; however, the depth dimension of the thread passing groove should only be approximately 2 mm to 6 mm, and the width dimension of thread passing groove should only be approximately 4 mm to 8 mm, for example. The receiving face 53*a* and the jump preventing faces 54*a* and 54*a* should only be extended upward as shown in the figure beyond the space 59 between the position of the through hole 33 of the thread take-up arm located at the bottom dead center 22*f* and the position of the second thread guide eye 32 provided therebelow.

Next, in each of the machine units 37, 37, . . . , 37 arranged in parallel, at the upper position of the thread passage 51 through which the first thread element 42 passes and on one side (the right side in FIG. 2) of each thread take-up arm 22, the first thread guide eye 31 for guiding the first thread element 42 supplied from the thread supply section 6*a* to the second thread guide eye 32 provided below via the thread passage 51 is provided (in FIG. 2, nine pieces are arranged in parallel so as to correspond to the number of the thread take-up arms).

Figure 3:
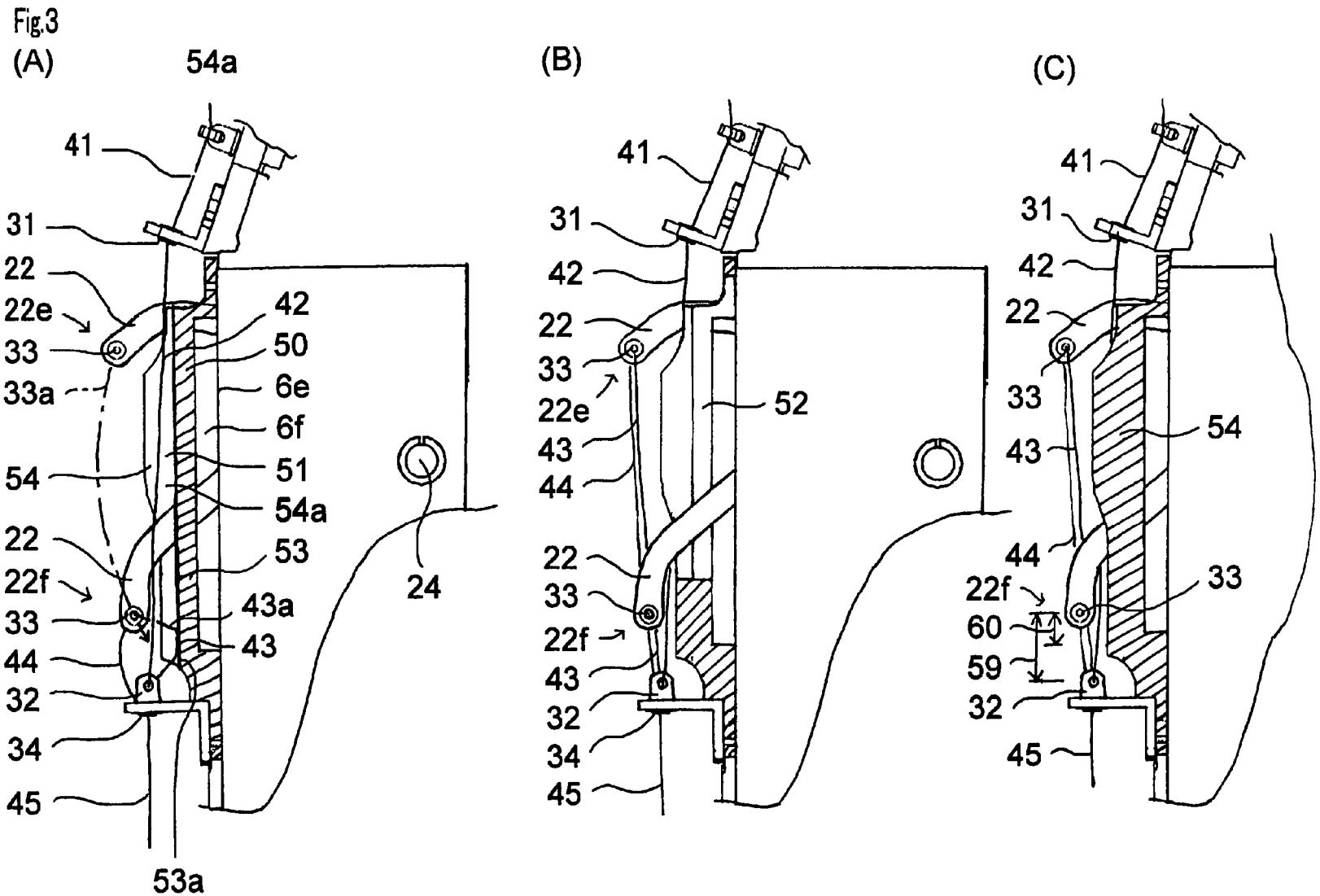
FIG. 3(A) is a cross-sectional view illustrating the positional relationship among the through hole of the thread take-up arm, the second thread element, the first thread element and the beaten thread receiving face at the A-A position of FIG. 2 so as to be understood easily.
FIG. 3(B) is a cross-sectional view illustrating the positional relationship among the through hole of the thread take-up arm, the second thread element, the first thread element and the beaten thread receiving face at the B-B position of FIG. 2 so as to be understood easily.
FIG. 3(C) is a cross-sectional view illustrating the positional relationship among the through hole of the thread take-up arm, the second thread element, the first thread element and the beaten thread receiving face at the C-C position of FIG. 2 so as to be understood easily.

Next, as shown in FIGS. 2 and 3, the position of each of the multiple second thread guide eyes 32 arranged in parallel, with respect to an extending member 56 provided below the thread twining preventing member 50, is determined at a lower position below each of the thread passages 51, and also below the position of the through hole 33 of each thread take-up arm 22 located at the bottom dead center 22*f*, while having the space 59 (for example, approximately 12 to 17 mm) determined usually.

The second thread guide eye 32 is configured so as to be able to return the first thread element 42 going down along each thread passage 51 and to guide the thread element serving as the second thread element 43 toward the through hole 33 of each thread take-up arm 22.

Next, each of the multiple third thread guide eyes 34 arranged in parallel, with respect to the extending member 56 provided below the thread twisting preventing member 50 shown in FIGS. 2 and 3, is provided in the vicinity (refer to FIG. 2) of the left side of each second thread guide eye 32 so as to be able to guide the third thread element 44 going to the corresponding needle 21*a* after passing through the through hole 33 of each take-up arm 22.

Figure 6:
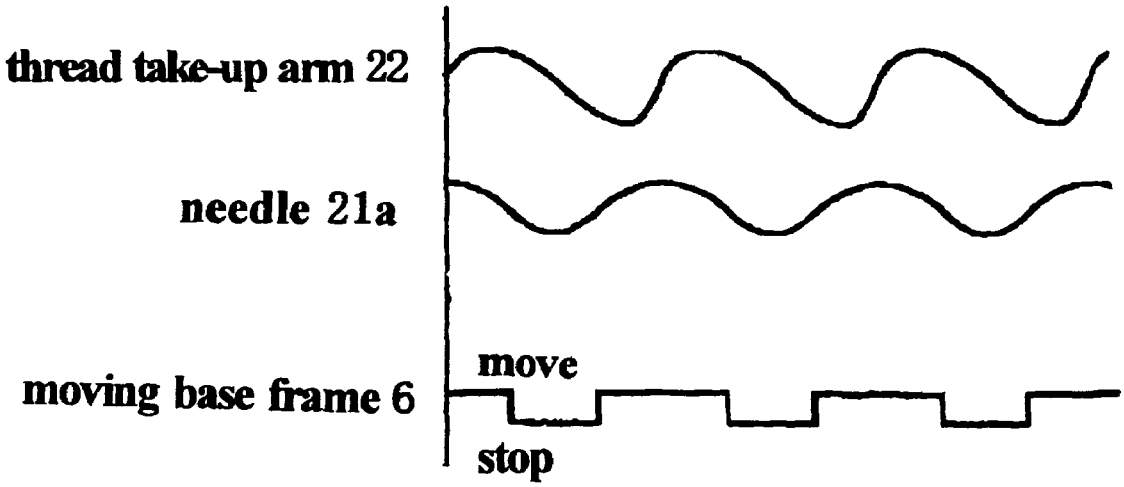
FIG. 6 is a timing chart illustrating the related operations of the take-up arm, needle, etc.

In the moving base frame 6, numeral 6*c* indicated in the lower portion designates a needle bar mechanism section, and a needle bar drive mechanism for vertically driving the needle bar 21 and the needle 21*a* of the selected machine unit 37 in synchronization (as shown in FIG. 6) with the selected thread take-up arm 22 as is well known, in synchronization with the rotation of the machine spindle as described above using FIG. 5(A) is incorporated inside.

In this kind of configuration, when sewing is carried out by moving the moving base frame 6 in the lateral direction (indicated by arrow 65), by selecting one of the multiple machine units 37 arranged in parallel and by vertically moving the thread take-up arm 22 and the needle bar 21 of the selected machine unit 37, the elements of the thread 41, such as the first thread element 42, the second thread element 43 and the third thread element 44, are sequentially guided using the first thread guide eye 31, the second thread guide eye 32, the through hole 33 of the thread take-up arm 22 and the third thread guide eye 34, thereby advancing toward the needle 21*a*.

The usage state of the sewing machine shown in FIGS. 1 to 4 (also refer to FIG. 5(A)) will be described. It is assumed that one of the multiple machine units 37 is selected as shown in the figure (for example, the fifth unit from the left in FIG. 2 is selected) and that sewing starts as is usually known. In this case, as the spindle 7 rotates at high speed, both the take-up arm 22 and the needle bar 21 vigorously move vertically (for example, vertical movement of 600 to 1200 times per minute), whereby embroidery is made on the cloth 29 stretched around an embroidery frame. The operation is done at the timing shown in FIG. 6. As the embroidery proceeds, the thread 41 supplied from the thread supply section 6*a* is supplied to the needle 21*a* sequentially. In this thread supplying process, when the thread take-up arm 22 lowers abruptly from the top dead center 22*e* to the bottom dead center 22*f*, the second thread element 43 located between the two points and having a length corresponding to the length between the two points becomes an "oversupply state" at the space (59) between the thread guide eye 32 and the through hole 33 of the thread take-up arm having been lowered to the bottom dead center 22*f* as shown in FIGS. 2, 3 and 4.

Figure 4:
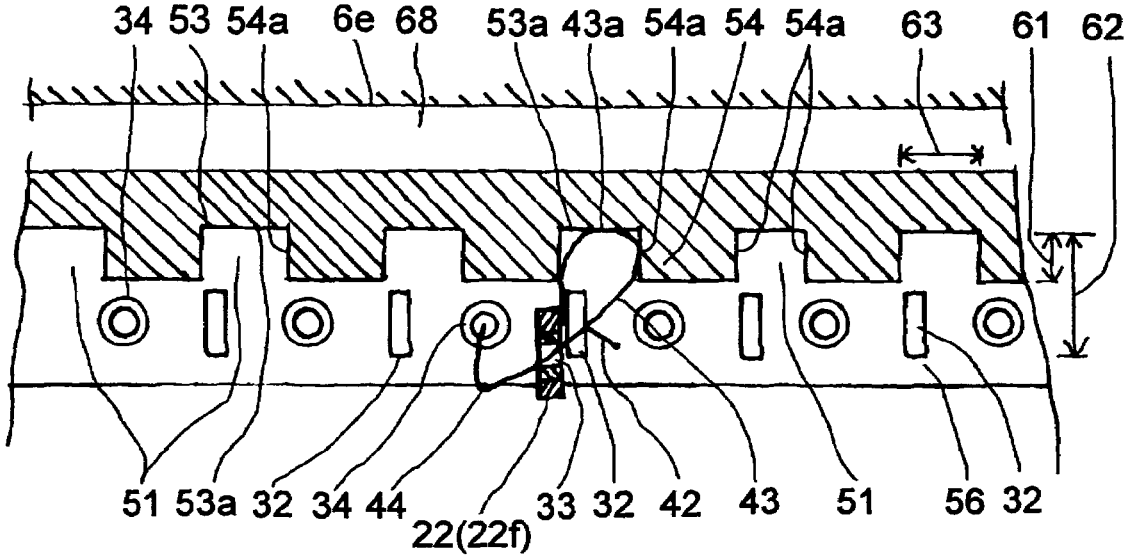
FIG. 4 is a cross-sectional view illustrating the positional relationship among the through hole of the thread take-up arm, the second thread element, the first thread element and the beaten thread receiving face at the D-D position of FIG. 2 so as to be understood easily.
Figure 5:
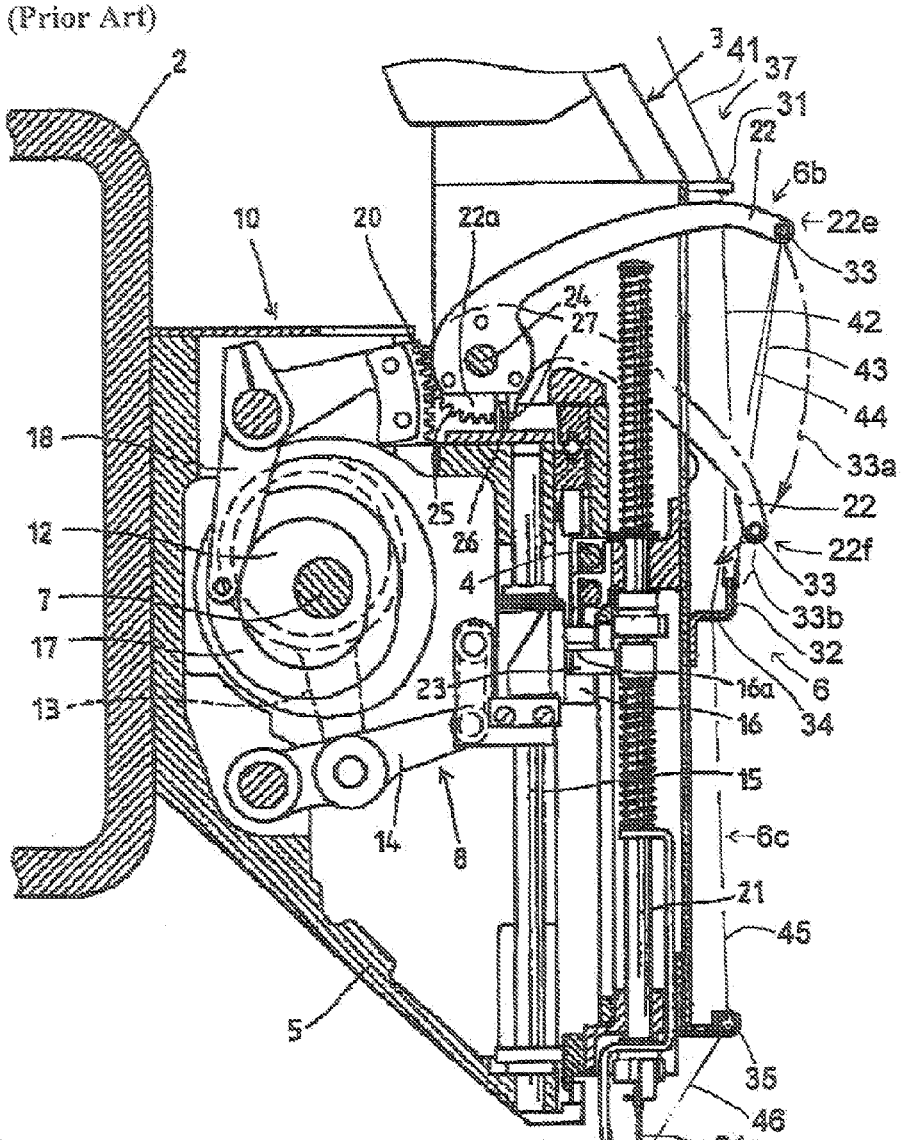
FIG. 5(A) is a vertical cross-sectional view illustrating the related operations in one of multiple machine units arranged in parallel, comprising a thread take-up arm, a needle bar, thread and thread guide eyes, according to the conventional multi-needle sewing machine.
FIG. 5(B) is a fragmentary view showing the twining state of the end 43*b* of a loop formed at the space 33*b* between the position of the through hole 33 of the thread take-up arm in the lowering state thereof and the thread guide eye 32.
Figure 5:
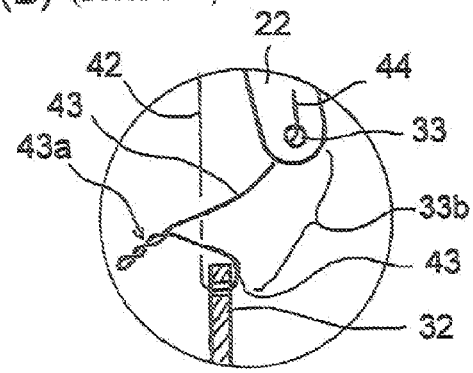

However, in the configuration shown in FIGS. 2, 3 and 4, the "oversupply portion 43*a*" of the second thread element 43 having been abruptly lowered together with the through hole 33 of the thread take-up arm is beaten to the "beaten thread receiving member 53*a*" provided in the depth of the thread guide eye 32 as shown in the figure and cannot rotate on its axis. Furthermore, the "oversupply portion 43*a*" of the second thread element 43, having gained momentum, is attached to the jump preventing faces 54*a* provided on both sides of the "beaten thread receiving member 53*a*" as shown in the figure, and cannot perform twisting (twining) by itself.

At the next moment, the thread take-up arm rises, and the second thread element 43 is pulled up. In this way, the "oversupply portion 43*a*" of the second threat element 43 can be used for continuous sewing without being twisted (twined).

The invention claimed is:

1. A multi-needle sewing machine comprising:

a moving base frame provided on the front side of a machine head so as to be able to reciprocate in the lateral direction, and multiple machine units arranged in parallel on the moving base frame, each of said machine units comprising a thread supply section, a thread take-up arm and a needle bar in this order from above, wherein said moving base frame is able to be reciprocated in the lateral direction so that any one of said multiple machine units can be selected and used;

a first thread guide eye located at an upper position of a thread passage on one side of said thread take-up arm in each of said machine units;

a second thread guide eye provided below said first thread guide eye; and a third thread guide provided in the vicinity of said second thread guide eye; wherein:

said first thread guide eve is arranged to guide a first thread element supplied from said thread supply section to said second thread guide eye via said thread passage;

a position of said second thread guide eye is determined at a lower position below said thread passage and below the position of the through hole of said thread take-up arm located at the bottom dead center while having a predetermined space;

said second thread guide eye is configured so as to be able to return said first thread element and to guide said first thread element toward said through hole of said thread take-up arm as a second thread element;

said third thread guide eye is arranged to guide a third thread element going to a needle after passing through said through hole of said take-up arm;

when sewing is earned out by vertically moving said thread take-up arm and said needle bar of said machine unit, said first thread element, said second thread element and said third thread element are sequentially guided using said first thread guide eye, said second thread guide eye, said through hole of said thread take-up arm and said third thread guide eye, thereby advancing toward said needle;

in said thread passage of each machine unit, in the upper half zone at least in said space between the position of said through hole of said thread take-up arm located at the bottom dead center and the position of said second thread guide eye provided therebelow, when said through hole of said thread take-up arm lowers abruptly from a top dead center to the bottom dead center, said second thread element is pulled using said through hole of said thread take-up arm and abruptly lowered, and said second thread element being in an oversupply state is deflected; and in a depth direction to which said second thread element is deflected and at a position near a place in which a beaten portion of said second thread element being deflected can be received, a beaten thread receiving face is provided, and jump preventing faces are provided to make the beaten portion of said second thread element come into contact with positions on both sides of said receiving face and enclosing a front space of said receiving face so as to prevent the oversupply portion of said second thread element from jumping.

* * * * *